US011509044B2

(12) United States Patent
Yokota et al.

(10) Patent No.: US 11,509,044 B2
(45) Date of Patent: Nov. 22, 2022

(54) ANTENNA DEVICE FOR VEHICLE

(71) Applicant: Yokowo Co., Ltd., Tokyo (JP)

(72) Inventors: Yusuke Yokota, Tomioka (JP); Taiki Mochizuki, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 31 days.

(21) Appl. No.: 17/253,145

(22) PCT Filed: Jun. 28, 2019

(86) PCT No.: PCT/JP2019/025780
§ 371 (c)(1),
(2) Date: Dec. 17, 2020

(87) PCT Pub. No.: WO2020/004612
PCT Pub. Date: Jan. 2, 2020

(65) Prior Publication Data

US 2021/0273320 A1 Sep. 2, 2021

(30) Foreign Application Priority Data

Jun. 29, 2018 (JP) ..... JP2018-124048

(51) Int. Cl.
*H01Q 1/32* (2006.01)
*H01Q 5/364* (2015.01)
(Continued)

(52) U.S. Cl.
CPC ..... *H01Q 1/325* (2013.01); *H01Q 1/42* (2013.01); *H01Q 5/364* (2015.01);
(Continued)

(58) Field of Classification Search
CPC ..... H01Q 13/08; H01Q 21/28; H01Q 9/42
See application file for complete search history.

(56) References Cited

U.S. PATENT DOCUMENTS

2014/0125549 A1 5/2014 Kaneko
2019/0280372 A1* 9/2019 Terashita ..... H01Q 1/52

FOREIGN PATENT DOCUMENTS

JP 2012-204996 A 10/2012
WO 2009/004451 A2 1/2009
WO 2018/105235 A1 6/2018

OTHER PUBLICATIONS

International Search Report and Written Opinion dated Aug. 3, 2019, received for PCT Application No. PCT/JP2019/025780, Filed on Jun. 28, 2019, 6 pages including English Translation.

* cited by examiner

*Primary Examiner* — Graham P Smith
(74) *Attorney, Agent, or Firm* — Xsensus LLP

(57) ABSTRACT

There is provided an antenna device for a vehicle capable of suppressing interference in a case where a plurality of antennas which receive signals in different frequency bands are close to one another. The antenna device for the vehicle includes a patch antenna and a capacitance loading element which are installed away from each other on an antenna base section which is attachable to a vehicle. The capacitance loading element is a part of an antenna capable of receiving a different use frequency band from which of the patch antenna, to form a three-dimensional shape in which a pair of linear conductors which respectively repeatedly turn in a predetermined direction are connected to each other via a linear connection conductor extending in a width direction of the antenna base section, and in the capacitance loading element, a length of a folded portion of each of the linear conductors is a non-resonant length of the patch antenna.

23 Claims, 12 Drawing Sheets

(51) Int. Cl.

| | |
|---|---|
| ***H01Q 1/42*** | (2006.01) |
| ***H01Q 9/04*** | (2006.01) |
| ***H01Q 9/42*** | (2006.01) |
| ***H01Q 21/28*** | (2006.01) |
| *H01Q 13/08* | (2006.01) |

(52) U.S. Cl.

CPC ..... *H01Q 9/0407* (2013.01); *H01Q 9/42* (2013.01); *H01Q 21/28* (2013.01); *H01Q 13/08* (2013.01)

ANTENNA DEVICE FOR VEHICLE

CROSS-REFERENCE TO RELATED APPLICATIONS

The present application is based on PCT filing PCT/JP2019/025780, filed Jun. 28, 2019, which claims priority to JP 2018-124048, filed Jun. 29, 2018, the entire contents of each are incorporated herein by reference.

TECHNICAL FIELD

The present invention relates to a low profile antenna device for a vehicle.

BACKGROUND ART

As a low profile antenna device for a vehicle, an antenna device disclosed in Patent Literature 1 has been known. The antenna device includes an element holder having an insulating property provided to stand on an antenna base, an umbrella-type element fixed to an upper part of the element holder, and a coil, together with the umbrella-type element, constituting an antenna section. The umbrella-type element is a plate-shaped conductor in which a first slant portion and a top portion, and a second slant portion and a top portion are respectively continuous with each other, and an area of the umbrella-type element is made as large as possible so that a gain increases.

PRIOR ART DOCUMENTS

Patent Literature

Patent Literature 1: Japanese Patent Laid-Open No. 2012-204996

SUMMARY OF INVENTION

Problems to Be Solved by the Invention

In the antenna device disclosed in Patent Literature 1, the umbrella-type element has a plate shape, and the first slant portion and the top portion, and the second slant portion and the top portion are respectively continuous with each other. Accordingly, there is a problem of affecting an antenna characteristic of another antenna element arranged in a common case. Particularly, in an antenna which receives a high frequency signal through a substantially circularly polarized wave, like a patch antenna, a gain decreases due to interference with the umbrella-type element and a maximum and minimum gain difference of in-horizontal-plane directivity increases.

A main object of the present invention is to provide an antenna device for a vehicle that suppresses a decrease in a gain of another antenna element and an increase in a maximum and minimum gain difference of in-horizontal-plane directivity.

Solution to the Problems

An antenna device for a vehicle according to a first aspect of the present invention includes an antenna base section that is attachable to a vehicle, and a first element and a second element that are installed away from each other on the antenna base section, in which the first element is a first antenna for a first frequency band, the second element is a part of a second antenna for a second frequency band different from the first frequency band, to have a three-dimensional shape in which a pair of linear conductors that respectively repeatedly turn in a predetermined direction are connected to each other via a linear connection conductor extending in a width direction of the antenna base section, and in the second element, a length of a folded portion of each of the linear conductors is a non-resonant length of the first antenna.

An antenna device for a vehicle according to a second aspect of the present invention includes an antenna base section that is attachable to a vehicle, and a first element and a second element that are installed away from each other on the antenna base section, in which the first element is a first antenna for a first frequency band, the second element is a part of a second antenna for a second frequency band different from the first frequency band, and includes an upper edge portion and a lower edge portion, and at least one length of a length in a front-rear direction of the upper edge portion, a length in the front-rear direction of the lower edge portion, and a length in a vertical direction between the upper edge portion and the lower edge portion is a non-resonant length of the first antenna.

Advantageous Effects of the Invention

According to the above-described aspect of the present invention, interference between the first antenna and the second antenna is suppressed, and thus, it is possible to suppress a decrease in a gain of the first antenna section and an increase in a maximum and minimum gain difference of in-horizontal-plane directivity.

DESCRIPTION OF EMBODIMENTS

Embodiments of the present invention will be described below with reference to the drawings.

Figure 1:
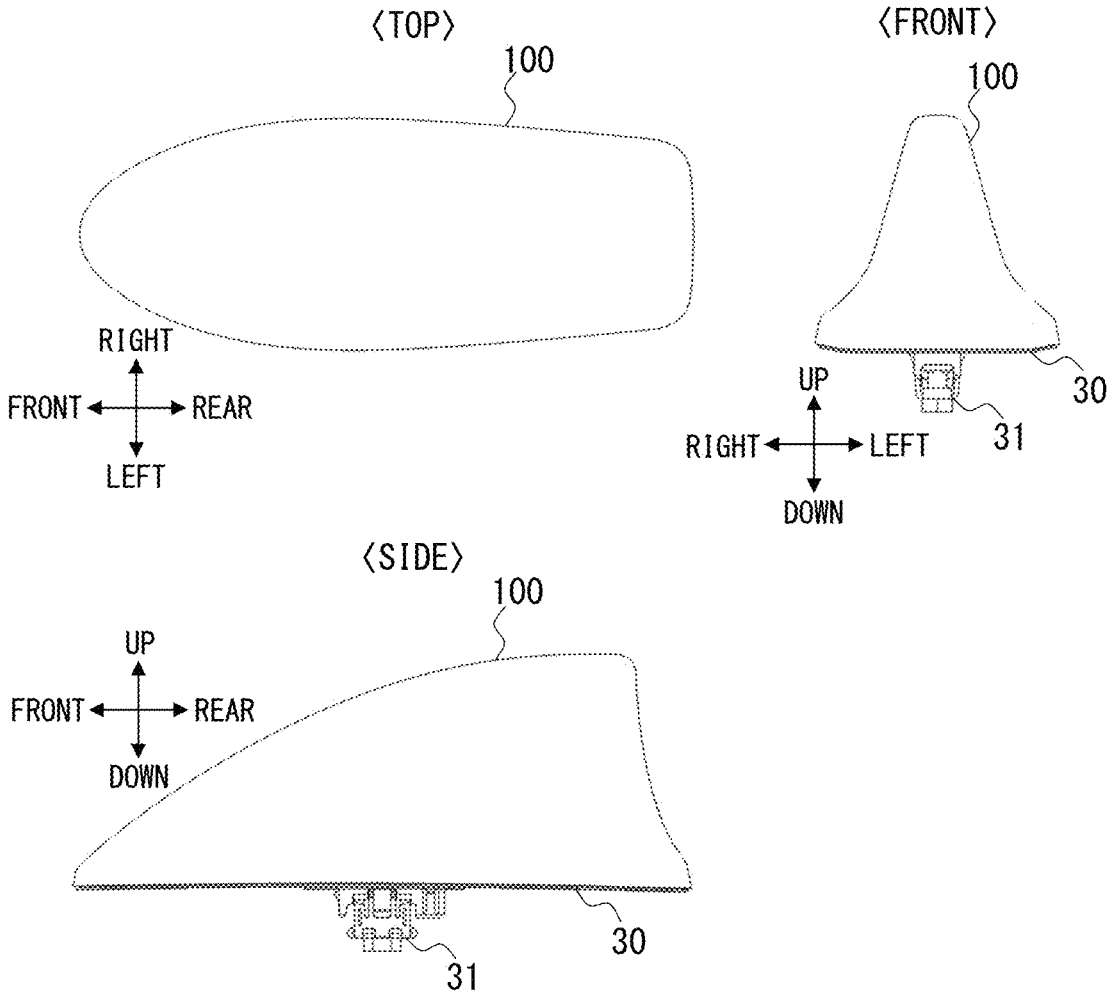
FIG. 1 illustrates a top external view, a front external view, and a side external view of an antenna device for a vehicle.

FIG. 1 illustrates a top external view, a front external view, and a side external view of an antenna device for a vehicle according to an embodiment of the present invention.

The antenna device for a vehicle is installed on a vehicle roof, for example. In the drawings, a direction of forward movement and an opposite direction thereto of a vehicle are respectively referred to as "front" or "forward" and "rear" and "rearward", and when not required to be distinguished, the direction of forward movement and the opposite direction thereto are referred to as a "longitudinal direction". The right side in the direction of forward movement and the left side in the direction of forward movement of the vehicle are respectively referred to as "right" or "rightward" and "left" and "leftward", and when not required to be distinguished, the right side and the left side in the direction of forward movement of the vehicle are referred to as a "width direction". A direction of gravity and an opposite direction thereto of the vehicle are respectively referred to as "down" or "downward" and "up" or "upward".

The antenna device for a vehicle according to the present embodiment is configured to include a case section 100 made of synthetic resin having radio wave transmissibility in which an accommodation space for accommodating an antenna section is formed, and an antenna base section 30 that is attachable to the vehicle. The antenna base section 30 has a substantially elliptical shape, and is attached such that its center axis line in the longitudinal direction is parallel to a traveling direction of the vehicle. In other words, the front of the vehicle is the front of the antenna base section 30 (the case section 100), the rear of the vehicle is the rear of the antenna base section 30 (the case section 100), and the width direction of the vehicle is the width direction of the antenna base section 30 (the case section 100). The case section 100 narrows and lowers toward the front, has its side surface molded into a streamline as a curved surface bent inward (toward a center axis line in the longitudinal direction), and is fitted in an outer edge of the antenna base section 30. A length in the longitudinal direction, a length in the width direction, and an upward length (height) of the case section 100 are respectively approximately 180 mm, approximately 70 mm, and approximately 70 mm. The antenna base section 30 is provided with a capture section 31 such that it is grounded while being fixed to the vehicle roof.

Figure 2:
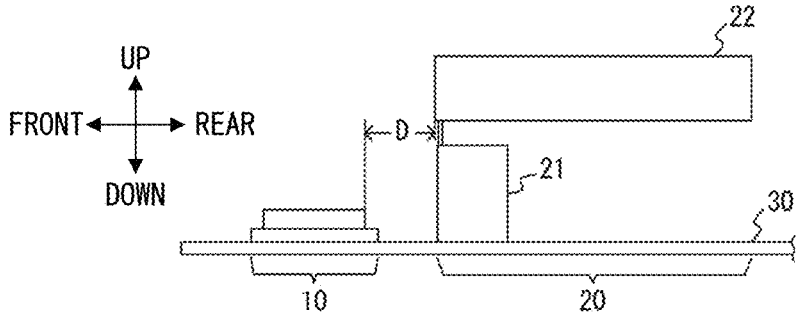
FIG. 2 is a schematic view illustrating an example of a structure of an antenna section in the antenna device for a vehicle.

FIG. 2 is a schematic view illustrating an example of a structure of the antenna section in the antenna device for a vehicle. The antenna section is configured to include two elements respectively installed away from each other on the antenna base section 30. The one element (first element) is a patch antenna 10 capable of receiving an SDARS (satellite digital audio radio service: a general term including XM and Sirius) band (a first frequency band). The patch antenna 10 is one type of planar antenna and has a substantially circularly polarized wave characteristic. The SDARS band is 2320 MHz to 2345 MHz, and one wavelength of 2332.5 MHz as a center frequency in a use (receivable) frequency band (which may be hereinafter merely referred to as a "use frequency") is approximately 128 mm. A wavelength of a resonant frequency, i.e., the user frequency is referred to as a "resonant length". An integer multiple of one-fourth of a wavelength $\lambda$ of the use frequency corresponds to a resonant length. All wavelengths of frequencies other than the resonant frequency are each a non-resonant length. In a resonance-type antenna such as an FM antenna or a patch antenna, a signal at a level where a desired gain is obtained cannot be received when a length of a conductor is a non-resonant length. In a case where the other antennas arranged in the same case are each configured in the resonant length of the patch antenna 10, an electrical characteristic of the patch antenna 10 is affected.

The other element (second element) is a capacitance loading element 22. The capacitance loading element 22 is a part of an AM/FM antenna 20 that resonates in an FM wave band when a helical element 21 as an inductor is connected thereto and also receives an AM wave band. Although a distance D between the patch antenna 10 and the front end of the capacitance loading element 22 also differs depending on a structure of the capacitance loading element 22, the distance D is generally approximately 20 mm to be approximately one-sixth of the wavelength λ of the use frequency of the patch antenna 10.

The capacitance loading element 22 is a three-dimensionally shaped element that is open in its upper end portion (upper edge portion) and its lower end portion (lower edge portion) substantially parallel to the antenna base section 30. As the upper end portion and the lower end portion, a pair of upper end portions and a pair of lower end portions respectively exist. The upper end portions and the lower end portions respectively oppose each other with a gap interposed therebetween.

More specifically, the capacitance loading element 22 includes a pair of linear conductors that repeatedly turns in a meander shape, for example, and a linear connection conductor that connects these linear conductors to each other to form the capacitance loading element 22 into a three-dimensional shape.

The capacitance loading element 22 can be elements in two types of aspects, described below, depending on a direction of the turn. In the capacitance loading element 22 in the one aspect, a pair of linear conductors that respectively repeatedly turn in a front-rear direction are connected to each other via the connection conductor extending in the width direction. For example, the pair of linear conductors repeatedly turns in the front-rear direction and a direction that nears the antenna base section 30, and then repeatedly turns in the front-rear direction to move away from the antenna base section 30 after its direction is changed to the width direction. The capacitance loading element 22 in such an aspect is referred to as a "lateral element" for convenience.

In the capacitance loading element 22 in the other aspect, the pair of linear conductors that respectively repeatedly turn in a vertical direction (in a direction from the lower end portion to the upper end portion, and in a direction from the upper end portion to the lower end portion) are connected to each other via the linear connection conductor extending in the width direction. For example, the pair of linear conductors repeatedly turns in the vertical direction to extend in a forward direction or a rearward direction, and then repeatedly turns in the vertical direction after its direction is changed to the width direction to extend in an opposite direction to that before the direction is changed. The capacitance loading element 22 in such an aspect is referred to as a "longitudinal element" for convenience. An example in a case where the capacitance loading element 22 is set as the lateral element and the longitudinal element will be described below.

First Example

Figure 3:
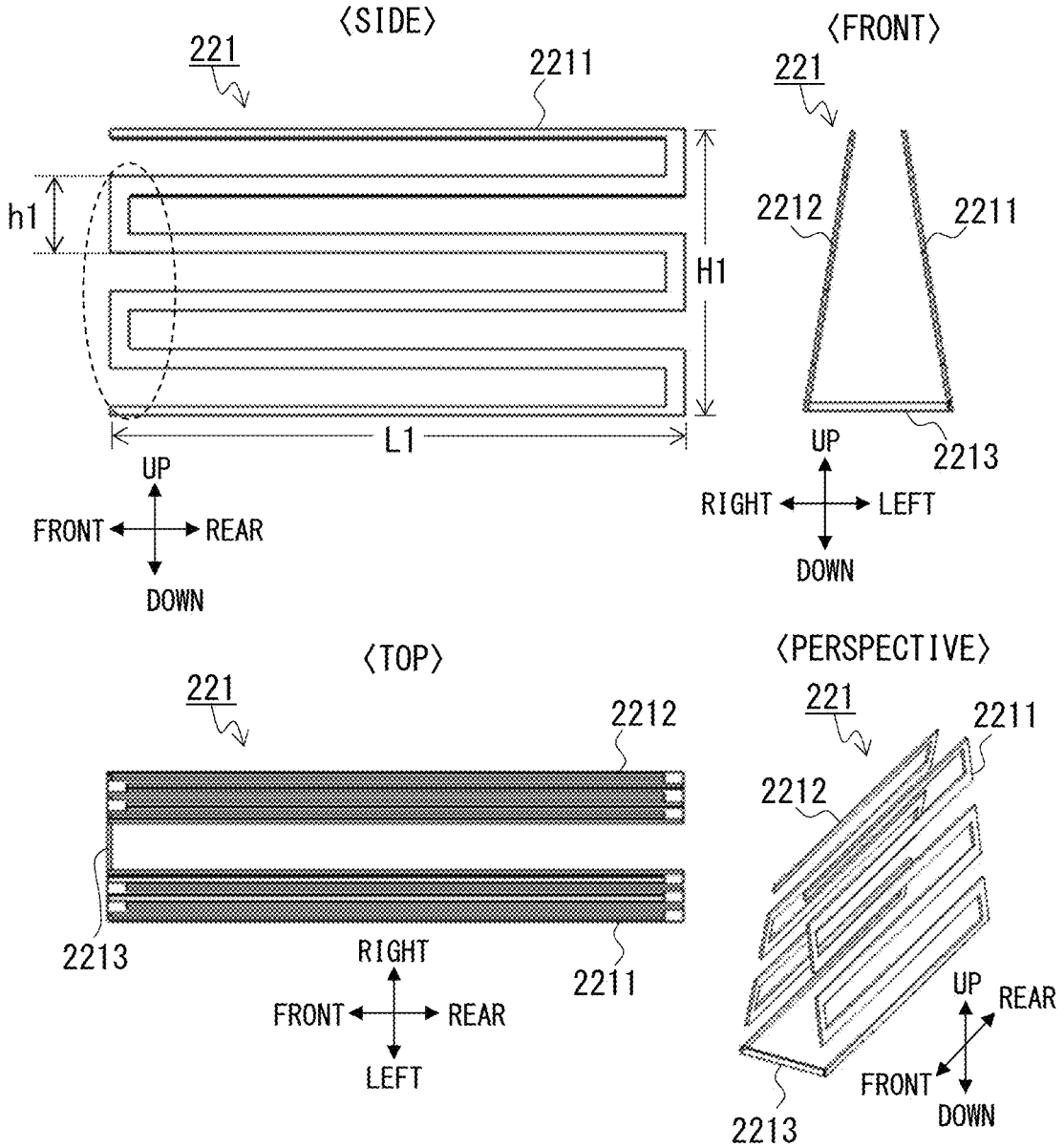
FIG. 3 illustrates a side external view, a top external view, a front external view, and a perspective external view of a lateral element according to a first example of a capacitance loading element.
Figure 4:
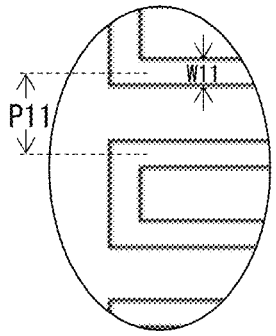
FIG. 4 is a partially enlarged view of a broken line portion illustrated in FIG. 3.

First, a first example of a capacitance loading element 22 will be described. The first example is an example of a lateral element. FIG. 3 illustrates a side external view, a top external view, a front external view, and a perspective external view of the lateral element. FIG. 4 is a partially enlarged view of a broken line portion illustrated in FIG. 3.

A lateral element 221 is molded into a three-dimensional shape by elements (referred to as "meander elements"; the same applies hereinafter) 2211 and 2212 obtained by turning a pair of linear conductors in a meander shape, for example, being connected to each other by a connection section 2213 that is the above-described connection conductor.

In the capacitance loading element 22, a length of a portion that turns (a folded portion) is a non-resonant length of the patch antenna 10. Specifically, in the portion that turns in the capacitance loading element 22, a length h1 of one side of a conductor extending in the vertical direction is 8 mm. A length in the front-rear direction (a length in the longitudinal direction of the upper end portion and the lower end portion) L1 is 50 mm, and a length of the connection section 2213 extending in the width direction is 15 mm. All the lengths are each the non-resonant length of the patch antenna 10. Accordingly, there is no or a small, if any, influence of the lateral element 221 on the patch antenna 10. At this time, a length in the vertical direction of each of the meander elements 2211 and 2212 (a length between the upper end portion and the lower end portion) H1 is 30 mm. H1 represents a length between a specific one point in the front-rear direction of the upper end portion and an intersection of a virtual line along a shape of the element in the vertical direction from the specific one point and a virtual line in the front-rear direction of the lower end portion. The length h1 of one side of the conductor extending in the vertical direction of each of the meander elements 2211 and 2212, the length L1 in the front-rear direction, and the length of the connection section 2213 are each an example, and if h1 (the length of one side of the conductor extending in the vertical direction in the portion that turns in the capacitance loading element 22) is the non-resonant length of the patch antenna 10, the length H1 in the vertical direction, the length L1 in the front-rear direction, and the length of the connection section 2213 are appropriately changeable. For example, the number of times of folding may be changed, as needed, and the length H1 in the vertical direction may be changed depending on the number of times of folding. Although description has been made assuming that a length on the outer side of the portion that turns is h1, and h1 is the non-resonant length, it is more desirable for a length on the inner side of the portion that turns to also be the non-resonant length.

Although an influence of a line width W11 that is a width of the linear conductor (an outer diameter in the case of a line conductor) and a pitch P11 that is a distance between center axes of the adjacent linear conductors, as illustrated in FIG. 4, on the patch antenna 10 and the AM/FM antenna 20 will be described below, the line width W11 is approximately 2 mm and the pitch P11 is approximately 6 mm in the example illustrated in FIG. 3.

The connection section 2213 is the same wire material as those of the helical element 21 and each of the meander elements 2211 and 2212. For example, the helical element 21, each of the meander elements 2211 and 2212, and the connection section 2213 are the same in cross-sectional shape and outer diameter, and are integrally configured. More specifically, the helical element 21, each of the meander elements 2211 and 2212, and the connection section 2213 are integrally formed of one wire material such as a copper wire.

The helical element 21, each of the meander elements 2211 and 2212, and the connection section 2213, which are independently configured, may be connected to one another by soldering or the like. In such a case, the helical element 21, each of the meander elements 2211 and 2212, and the connection section 2213 may be respectively formed of wire materials made of the same material, or may be respectively formed of wire materials having the same cross-sectional shape and outer diameter and made of different materials. For example, the helical element 21 as an inductor may be formed of a linear conductor made of the same members or having the same cross-sectional shape as that of each of the meander elements 2211 and 2212. The helical element 21 having the same cross-sectional shape and outer diameter as those of each of the meander elements 2211 and 2212 and the connection section 2213 configured by processing a metal component such as a metal plate may be connected to the meander elements 2211 and 2212 and the connection section 2213 by soldering or the like.

The pair of meander elements 2211 and 2212 that respectively repeatedly turn form a symmetrical shape with a surface (virtual surface) perpendicular to the antenna base section 30 as its center. For example, the pair of meander elements 2211 and 2212 are molded into a shape of Katakana letter "ha" (an inverted V shape the lines of which are spaced apart from each other) as viewed from the front. In this case, respective distances from the virtual surface to the pair of upper end portions are equal to each other, and respective distances from the virtual surface to the pair of lower end portions are equal to each other. A gap between the pair of lower end portions is larger than a gap between the pair of upper end portions. As a result, a predetermined capacitance can be loaded into the helical element 21.

The helical element 21 and the capacitance loading element 22 may be connected to each other by arranging a metal plate between the helical element 21 and the capacitance loading element 22 and via the metal plate by soldering, for example.

Figure 5:
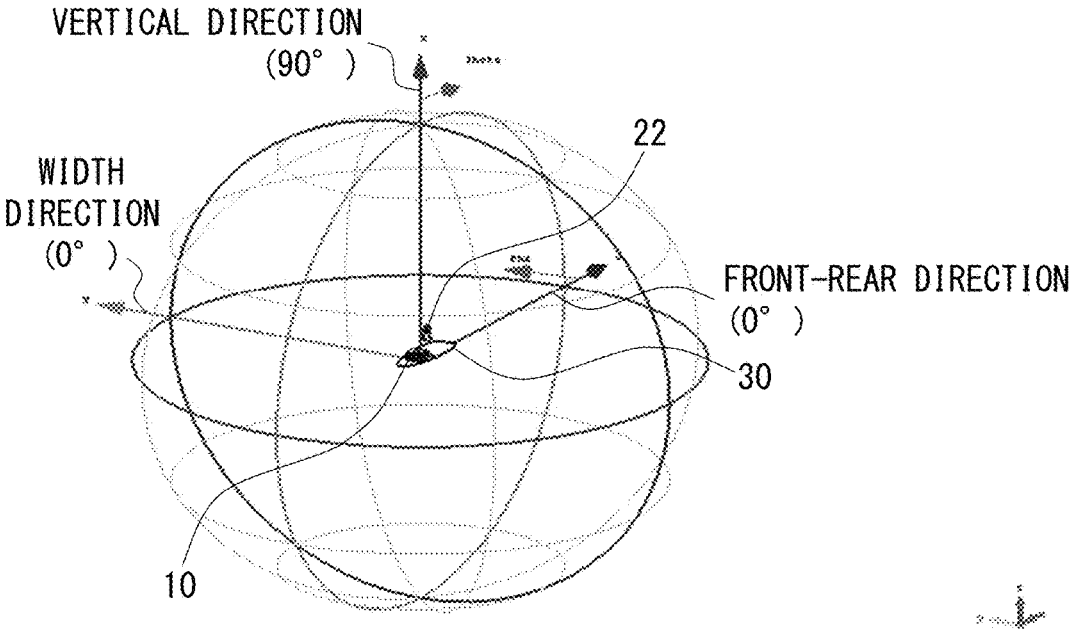
FIG. 5 is an explanatory view for defining a direction and an elevation angle viewed from a patch antenna.

FIG. 5 is an explanatory view for defining an elevation angle viewed from the patch antenna 10. An upward direction in the vertical direction as viewed from the antenna device for a vehicle is particularly referred to as a "zenith direction". In the zenith direction, an elevation angle is 90 degrees. The elevation angles in the front-rear direction and the width direction are each 0 degrees. The elevation angle of 0 degrees is for receiving a ground wave.

Figure 6:
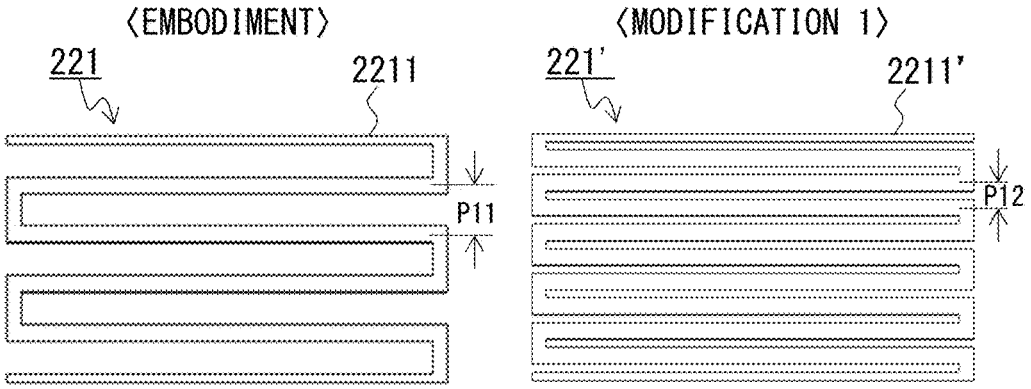
FIG. 6 is a side view of the lateral element according to the first example and a lateral element according to a modification 1 in which a pitch of the lateral element has been changed.

The lateral element 221 can be formed of various patterns. FIG. 6, for example, is a side view of a lateral element 221' according to a modification 1 in which the lateral element 221 and the pitch P11 have been changed. Although a length (height) H1 in the vertical direction, a length L1 in the front-rear direction, and a line width W11 of a meander element 2211' in the lateral element 221' are similar to those of the meander element 2211 in the example illustrated in FIG. 3, a pitch P12 is approximately 3 mm that is half of the above-described pitch P11 (approximately 6 mm).

Figure 7A:
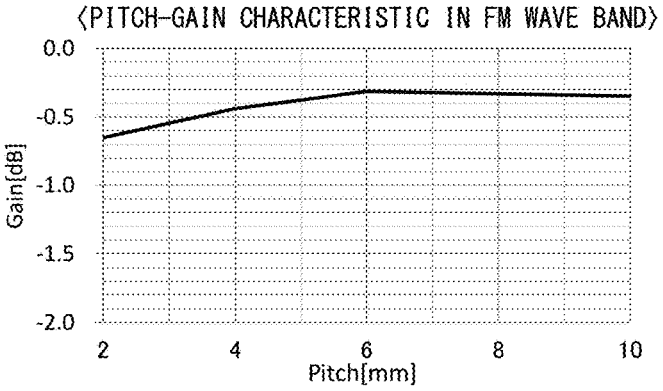
FIG. 7A is a diagram illustrating a pitch-gain characteristic of an FM wave band using the pitch of the lateral element as a parameter.
Figure 7B:
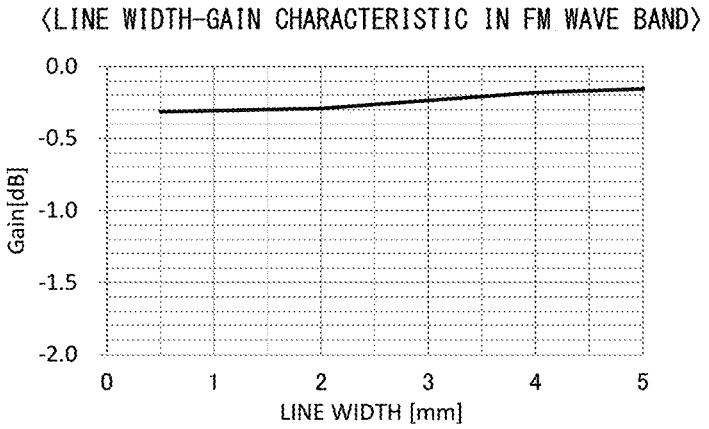
FIG. 7B is a diagram illustrating a line width-gain characteristic of an FM wave band using a line width of the lateral element as a parameter.

FIG. 7A is a diagram illustrating a pitch-gain characteristic of an FM wave band in a case where the pitch (P11: Pitch: mm) of the lateral element 221 is used as a parameter, and FIG. 7B is a diagram illustrating a line width-gain characteristic of an FM wave band in a case where the line width (W11: mm) of the lateral element 221 is used as a parameter. As can be seen from the drawings, a gain (Gain (an average gain): dB) in the FM wave band of the lateral element 221 increases as a pitch of the meander element 2211 increases and as a line width of the meander element 2211 increases.

Figure 8A:
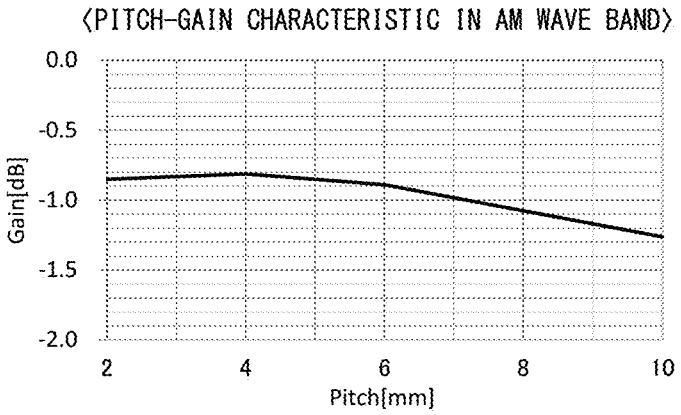
FIG. 8A is a diagram illustrating a pitch-gain characteristic of an AM wave band using the pitch of the lateral element as a parameter.
Figure 8B:
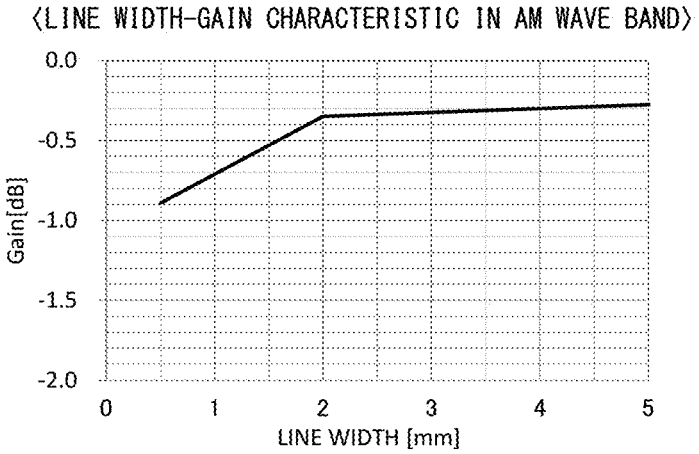
FIG. 8B is a diagram illustrating a line width-gain characteristic of an AM wave band using a line width of the lateral element as a parameter.

FIG. 8A is a diagram illustrating a frequency-gain characteristic of an AM wave band using a pitch (P11: Pitch: mm) of the lateral element 221 as a parameter, and FIG. 8B is a diagram illustrating a frequency-gain characteristic of an AM wave band using the line width (W11: mm) of the lateral element 221 as a parameter. As can be seen from the drawings, a gain (Gain (an average gain): dB) in the AM wave band of the lateral element 221 increases as the pitch of the meander element 2211 decreases. The gain increases as the line width of the meander element 2211 increases.

Figure 9A:
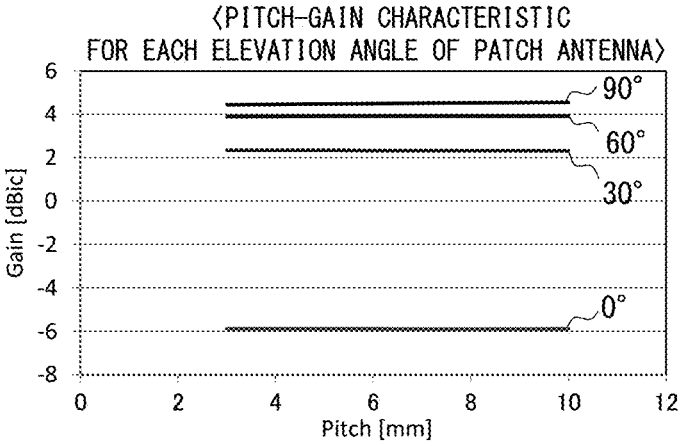
FIG. 9A is a diagram illustrating a pitch-gain characteristic for each elevation angle of the patch antenna using the pitch of the lateral element as a parameter.
Figure 9B:
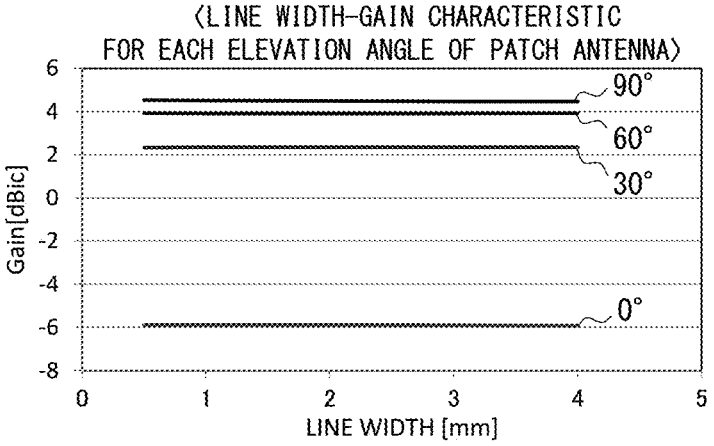
FIG. 9B is a diagram illustrating a line width-gain characteristic for each elevation angle of the patch antenna using the line width of the lateral element as a parameter.

FIG. 9A is a diagram illustrating a pitch-gain characteristic for each elevation angle of the patch antenna 10 using the pitch (P11: Pitch: mm) of the lateral element 221 as a parameter, and FIG. 9B is a diagram illustrating a line width-gain characteristic for each elevation angle of the patch antenna 10 using the line width (W11: mm) of the lateral element 221 as a parameter. A gain (Gain (an in-horizontal-plane average gain): dBic) in the zenith direction (the elevation angle of 90 degrees) is 4.4 when the pitch P11 of the meander element 2211 is 3 mm, is 4.5 when the pitch P11 is 7.5 mm, and is 4.6 when the pitch P11 is 10 mm. A gain (Gain: dBic) at an elevation angle of 60 degrees is 3.9 in any case where the pitch P11 of the meander element 2211 is 3 mm to 10 mm. A gain (Gain: dBic) at an elevation angle of 30 degrees is 2.3 in any case where the pitch P11 of the meander element 2211 is 3 mm to 10 mm. A gain (Gain: dBic) at an elevation angle of 0 degrees, that is, in a horizontal direction is −5.9 in any case where the pitch P11 of the meander element 2211 is 3 mm to 10 mm.

In other words, in the lateral element 221, an influence of the pitch P11 and the line width W11 of the meander element 2211 on the gain is small in the SDARS band, and thus, the pitch P11 and the line width W11 may be satisfactory when they optimize the respective gains in the AM wave band and the FM wave band.

Figure 10:
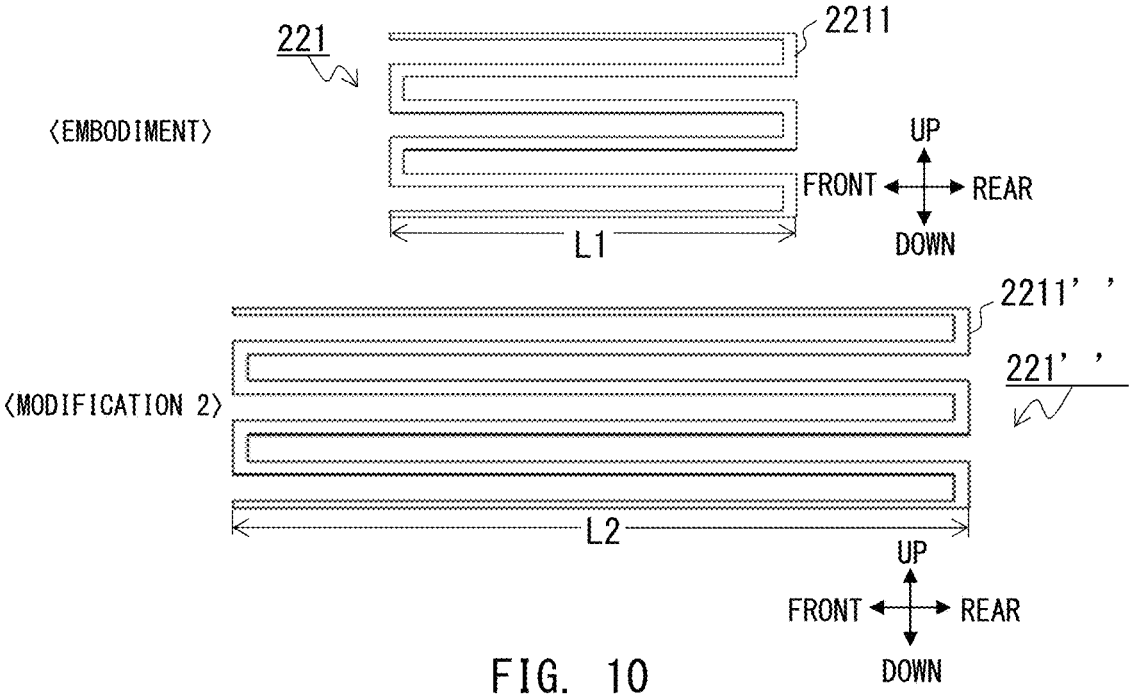
FIG. 10 is a side view of a lateral element according to a modification 2 in which the lateral element according to the example and its length in a front-rear direction have been changed.

FIG. 10 is a side view of a lateral element 221" according to a modification 2 in which the lateral element 221 and the length thereof in the front-rear direction have been changed. A meander element 2211" in the lateral element 221" is the same in pitch (P11) and line width (W11) as the meander element 2211 according to the example, but differs therefrom in that a length L2 in a front-rear direction is larger than the length L1 in the front-rear direction.

Figure 11A:
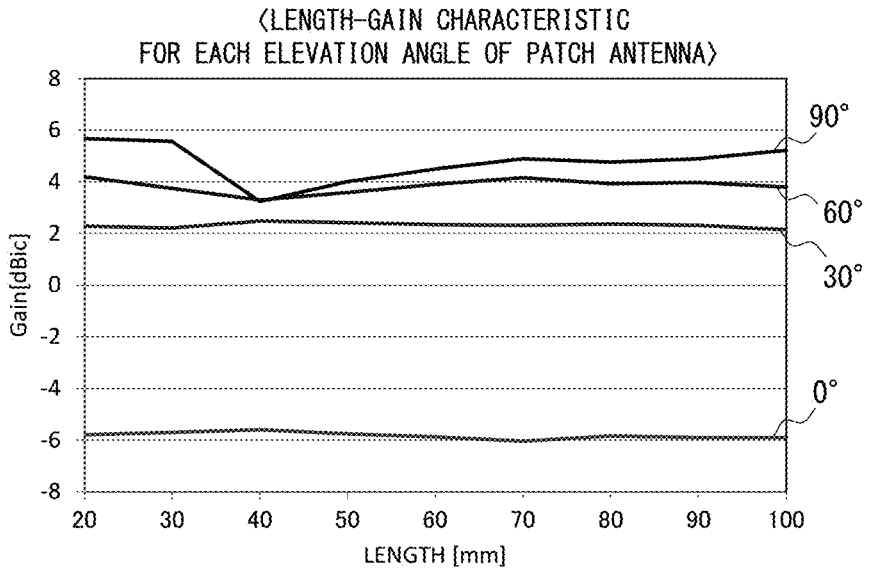
FIG. 11A is an explanatory view of a length-gain characteristic for each elevation angle of the patch antenna using the length in the front-rear direction of the lateral element as a parameter.
Figure 11B:
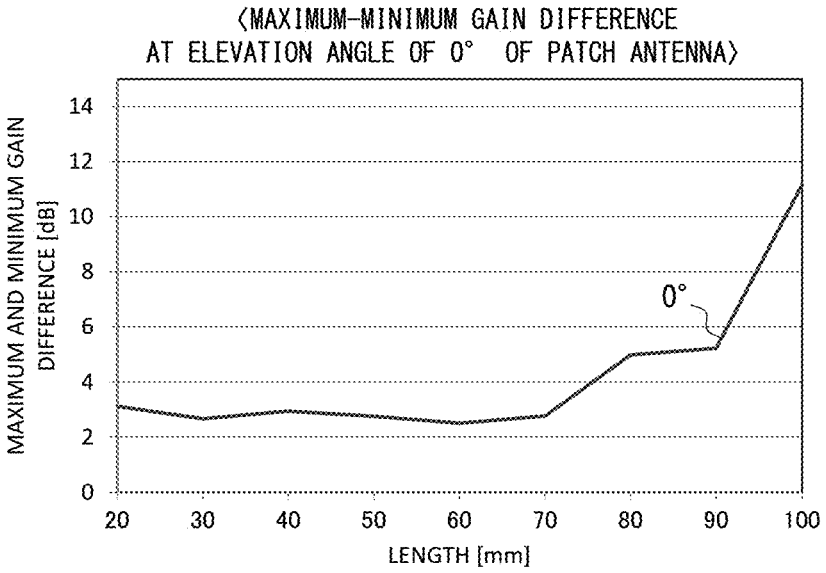
FIG. 11B is an explanatory view of a maximum and minimum gain difference of the patch antenna at an elevation angle of 0 degrees of the patch antenna using the length in the front-rear direction of the lateral element as a parameter.

FIG. 11A is an explanatory view of a length-gain characteristic for each elevation angle of the patch antenna 10 using the length in the front-rear direction of the lateral element 221 as a parameter, and FIG. 11B is an explanatory view of a maximum and minimum gain difference of the patch antenna 10 at an elevation angle of 0 degrees. The elevation angle of 0 degrees is the front-rear direction and the width direction on a plane parallel to the antenna base section 30. A gain at an elevation angle of 90 degrees (Gain (an in-horizontal-plane average gain): dBic) is 5.7 when the length in the front-rear direction is 20 mm, is 5.6 when the length is 30 mm, is 3.2 when the length is 40 mm, is 4.0 when the length is 50 mm, is 4.5 when the length is 60 mm, is 4.9 when the length is 70 mm, is 4.8 when the length is 80 mm, is 4.9 when the length is 90 mm, and is 5.2 when the length is 100 mm. In other words, the gain is substantially constant when the length is from 60 mm and 90 mm.

The maximum and minimum gain difference at the elevation angle of 0 degrees rapidly increases when the length in the front-rear direction of the lateral element 221 is 90 mm or more. The length corresponds to approximately three-fourths of one wavelength of the use frequency in the SDARS band. Accordingly, the length in the front-rear direction is desirably set to be other than the resonant length of the patch antenna 10 and not to exceed 90 mm. Even if the length in the front-rear direction is approximately 40 mm, for example, a required performance in practical use is satisfied, and thus, the length in the front-rear direction may be satisfactory when it is considered to optimize the respective gains in the AM wave band and the FM wave band.

<Comparison with Element in Comparative Example>

The inventors of the present application produce an element in a comparative example and simulates its antenna characteristic to clarify a difference in configuration and function and effect from the lateral element 221 having the configuration according to the first example and the element disclosed in Patent Literature 1. The element in the comparative example is obtained by molding the capacitance loading element 22 into an umbrella having a shape and a size illustrated in a side external view, a top external view, a front external view, and a perspective external view illustrated in FIG. 12 in a state with an arrangement of the antenna section illustrated in FIG. 2 maintained. For convenience, the entire antenna in the comparative example is referred to as an "umbrella-type element".

Figure 12:
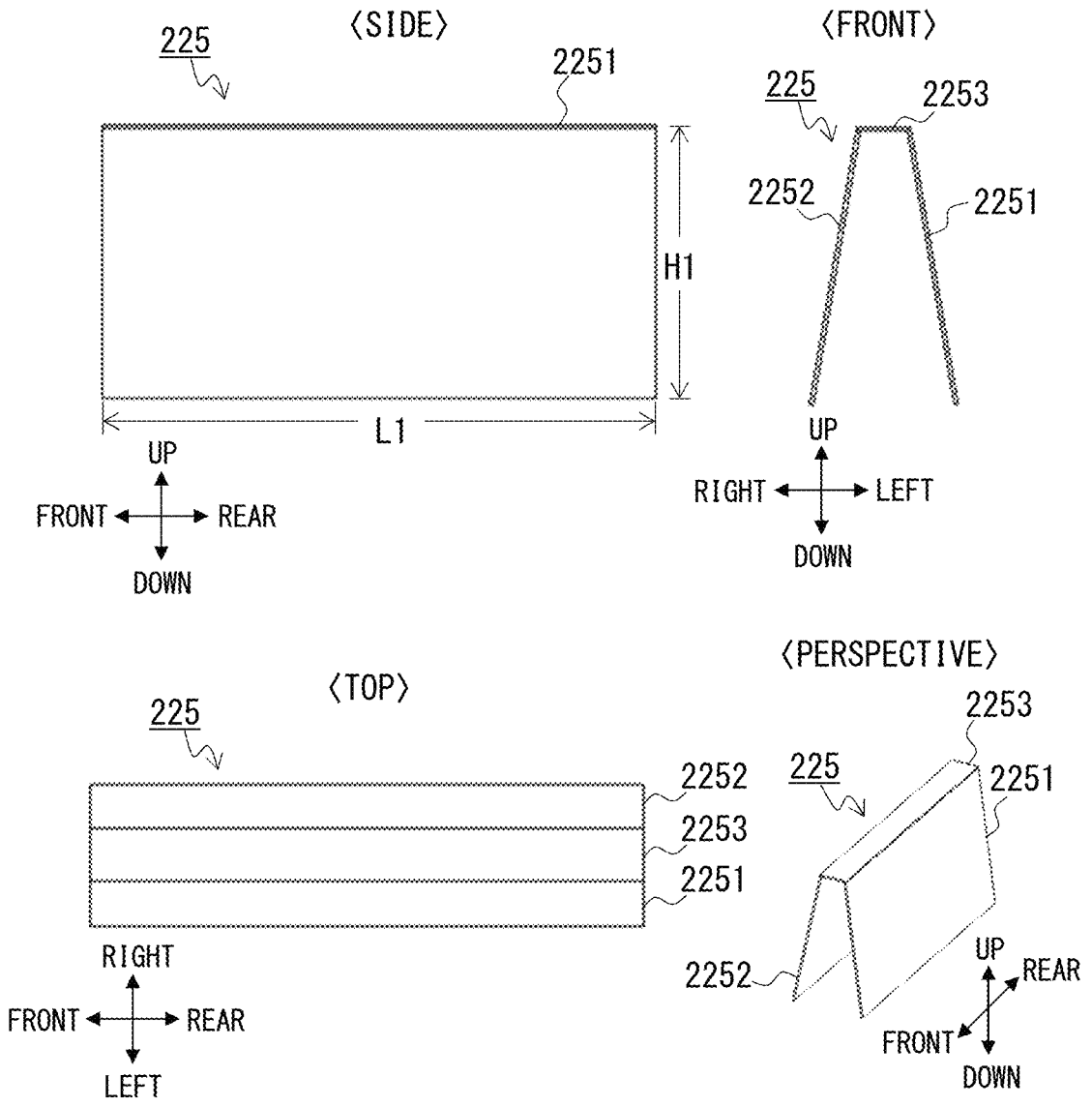
FIG. 12 illustrates a side external view, a top external view, a front external view, and a perspective external view of an element in a comparative example.

An umbrella-type element 225 has a three-dimensional shape in which a pair of slant portions 2251 and 2252 consecutively extends from a top portion 2253, and is open in only its lower end portion, as indicated by structures in a front view and a perspective view illustrated in FIG. 12. The slant portions 2251 and 2252 are the same in shape and size, and are similar to the lateral element 221 according to the first example in a length L1 in the front-rear direction, in a length H1 in the vertical direction, and in that they have a symmetrical shape with a surface (virtual surface) perpendicular to an antenna base section as its center, in a gradient to the virtual surface, and the like. The material, thickness, and the like are also similar to the lateral element 221.

Figure 13:
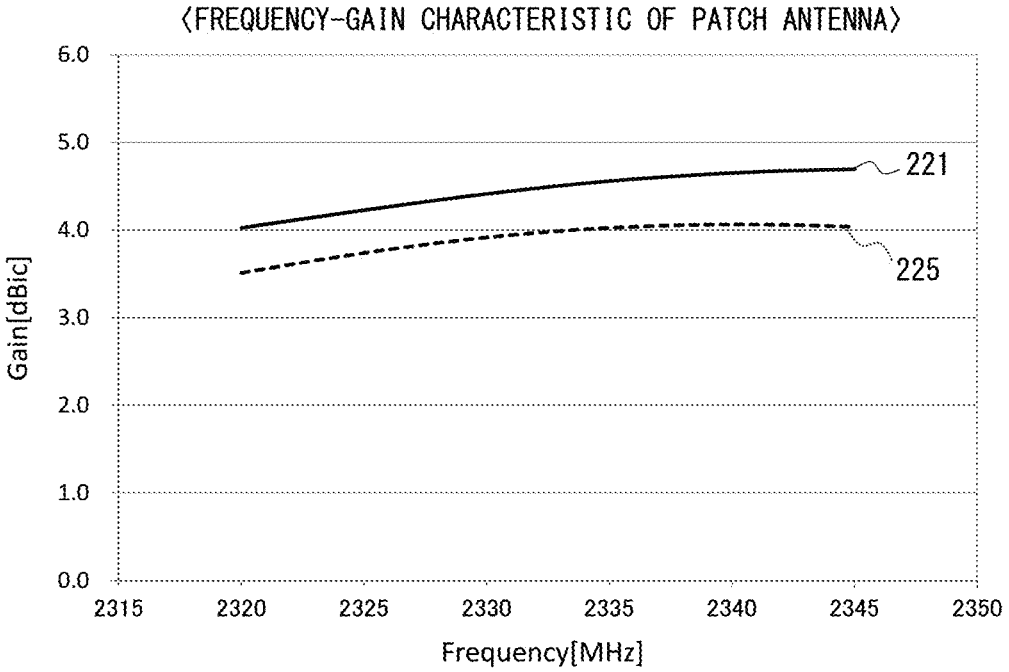
FIG. 13 is a diagram illustrating a comparative example of respective frequency-gain characteristics of the patch antenna in a case where the lateral element exists and a case where the element in the comparative example exists.

A comparative example of respective frequency-gain characteristics of the patch antenna 10 in a case where the lateral element 221 exists and a case where the umbrella-type element 225 exists in the capacitance loading element 22 according to the first example is illustrated in FIG. 13. In FIG. 13, a horizontal axis represents a frequency (2320 MHz to 2345 MHz) in the SDARS band, and a vertical axis represents an in-horizontal-plane average gain (dBic) at an elevation angle of 90 degrees. A solid line represents a characteristic in the case where the lateral element 221 exists, and a broken line represents a characteristic in the case where the umbrella-type element 225 exists.

If the umbrella-type element 225 exists, a gain (dBic) of the patch antenna 10 is 3.51 in a low frequency band of 2320 MHz, is 3.98 at a use frequency of 2332.5 MHz, and is 4.04 in a high frequency band of 2345 MHz. On the other hand, if the lateral element 221 exists, a gain (dBic) of the patch antenna 10 is 4.03 in a low frequency band of 2320 MHz, is 4.49 at a use frequency of 2332.5 MHz, and is 4.70 in a high frequency band of 2345 MHz. Thus, it is found that a gain at an elevation angle of 90 degrees increases more over an entire frequency band when the capacitance loading element 22 existing near the patch antenna 10 is the lateral element 221 than when the capacitance loading element 22 is the umbrella-type element 225.

Figure 14A:
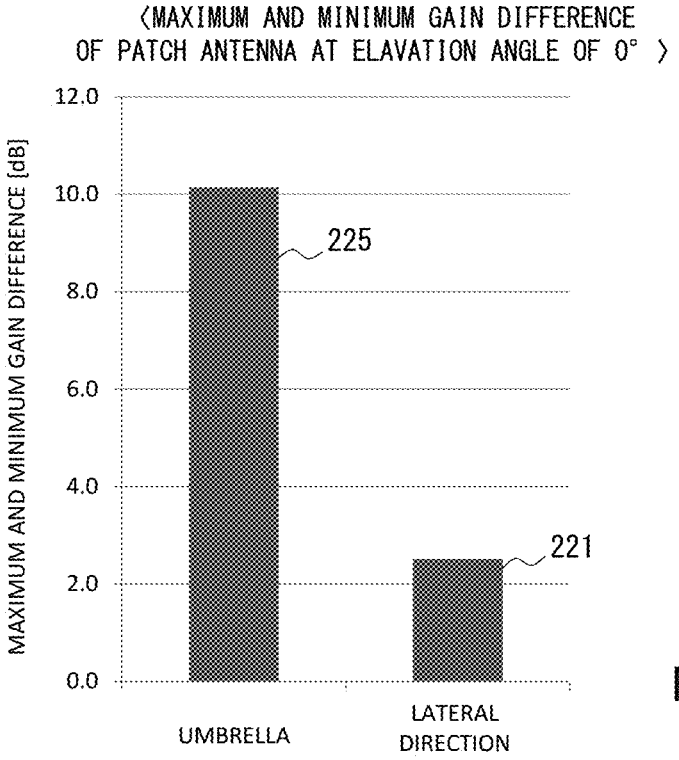
FIG. 14A is a diagram illustrating a comparative example of respective maximum and minimum gain differences (dB) of the patch antenna at a use frequency in an SDARS band at an elevation angle of 0 degrees in a case where the lateral element exists and a case where the element in the comparative example exists.
Figure 14B:
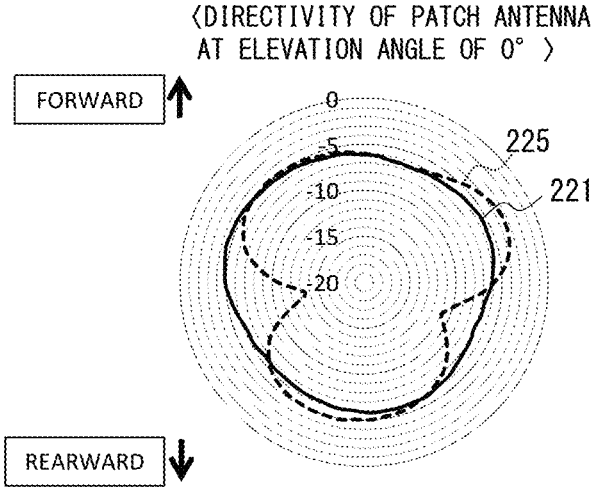
FIG. 14B is a diagram illustrating a comparative example of respective directivities of the patch antenna 10 at an elevation angle of 0 degrees in a case where the lateral element exists and a case where the element in the comparative example exists.

FIG. 14A is a diagram illustrating a comparative example of a maximum and minimum gain difference (dB) of the patch antenna 10 at a use frequency (2332.5 MHz) in the SDARS band at an elevation angle of 0 degrees, and FIG. 14B is a diagram illustrating a comparative example of directivity of the patch antenna 10 at an elevation angle of 0 degrees. A scale (0 to −20) of the directivity is a circularly polarized wave gain (dBic), where an upper part in the drawing is a forward direction, and a lower part in the drawing is a rearward direction. The maximum and minimum gain difference (dB) of the patch antenna 10 is 10.1 when the capacitance loading element 22 is the umbrella-type element 225 while it decreases to 2.5 when the capacitance loading element 22 is the lateral element 221. It is found that for the directivity, a gain in the width direction (left-right direction) rapidly decreases when the capacitance loading element 22 is the umbrella-type element 225, while a gain is uniformly obtained over almost all directions when the capacitance loading element 22 is the lateral element 221.

In other words, if the lateral element 221 is used as the capacitance loading element 22, it is found that effects of reducing a maximum and minimum gain difference of a ground wave are significantly excellent.

Effects on the above-described maximum and minimum gain difference will be specifically described. In a case where the length h1 of one side of the conductor extending in the vertical direction in the capacitance loading element 22 is the resonant length in the SDARS band, a current in the vertical direction is generated in the capacitance loading element 22. At this time, directivity reaches its maximum in the front-rear direction (horizontal direction) of the capacitance loading element 22. As a result, the generated current interferes with directivity of a ground wave (in the horizontal direction) of the patch antenna 10 so that the maximum and minimum gain difference increases.

A length h1 of the umbrella-type element 225 is 30 mm. Therefore, the length h1 is the resonant length in the SDARS band, and accordingly, an unnecessary electric wave is radiated in the front-rear direction (horizontal direction) of the umbrella-type element 225, and interferes with the ground wave directivity of the patch antenna 10 so that a maximum and minimum gain difference increases.

In the first example, the conductor extending in the vertical direction is folded to have a meander structure such that the length h1 of one side of the conductor is not the resonant length in the SDARS band. At this time, the above-described length h1 is approximately 8 mm. In other words, the linear conductors in the capacitance loading element 22 respectively repeatedly turn in the front-rear direction of the antenna base section, and a length in the vertical direction of a portion that turns in each of the linear conductors is a non-resonant length of the patch antenna 10. Thus, as the above-described length h1 is the non-resonant length in the SDARS band in the first example, the current in the vertical direction is not generated, and accordingly does not affect the ground wave directivity of the patch antenna 10.

Second Example

Figure 15:
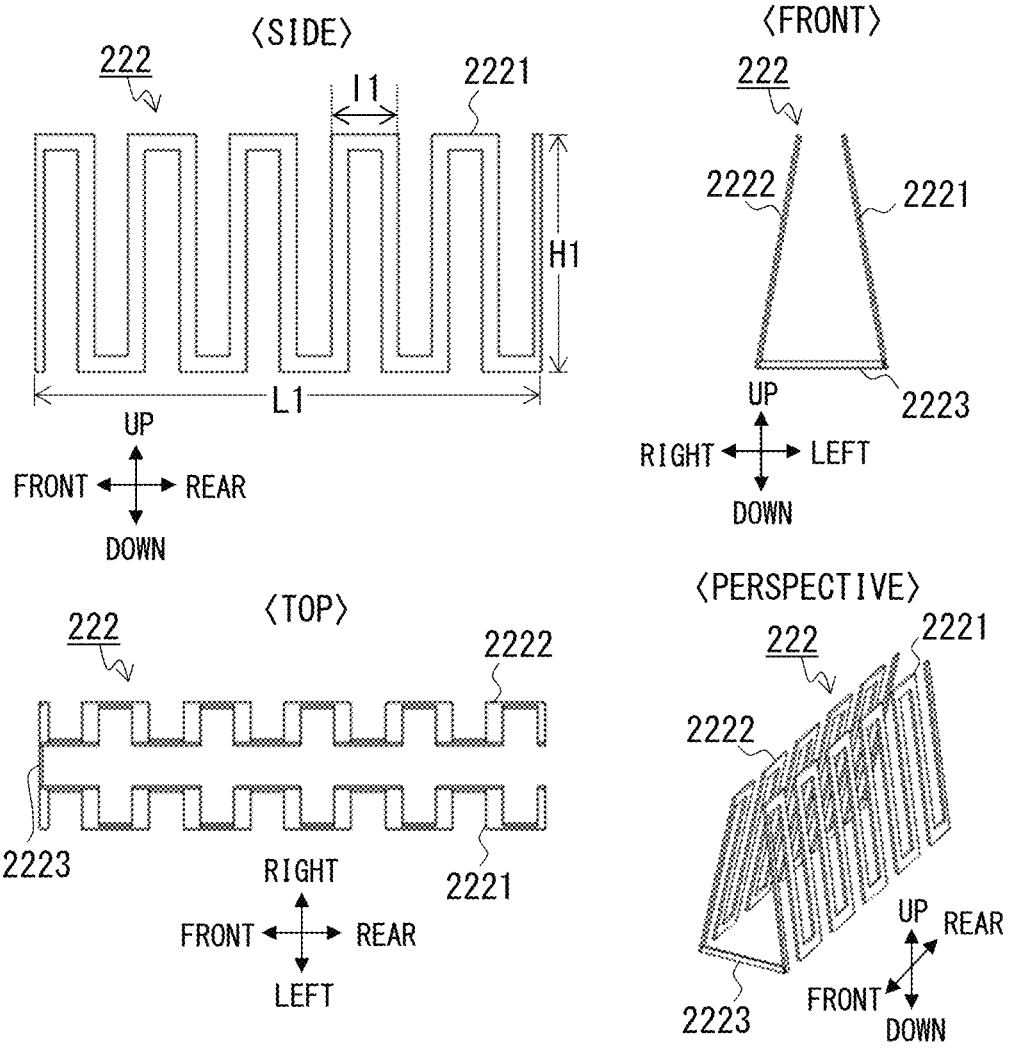
FIG. 15 illustrates a side external view, a top external view, a front external view, and a perspective external view of a longitudinal element according to a second example of a capacitance loading element.

Then, a second example of a capacitance loading element 22 will be described. The second example is an example of a longitudinal element. FIG. 15 illustrates a side external view, a top external view, a front external view, and a perspective external view of the longitudinal element. The longitudinal element 222 is molded in a three-dimensional shape by connecting a pair of meander elements 2221 and 2222 to each other via a connection section 2223 that is a connection conductor. The longitudinal element 222 only differs from the lateral element 221 according to the first example in a direction of turning of a linear conductor, and is similar to the lateral element 221 in a length L1 in a front-rear direction, a length (H1) in a vertical direction, a line width, a pitch, and the like.

In other words, in the longitudinal element 222, the length H1 in the vertical direction of each of the meander elements 2221 and 2222 is 30 mm. In the capacitance loading element 22, a length of a portion that turns is a non-resonant length of a patch antenna 10. Specifically, in the portion that turns in the capacitance loading element 22, a length l1 of one side of a conductor extending in the front-rear direction is 8 mm. A length of the connection section 2223 is 15 mm, and both the lengths are each the non-resonant length of the patch antenna 10. Accordingly, there is no or a small, if any, influence of the longitudinal element 222 on the patch antenna 10. At this time, the length L1 in the front-rear direction of each of the meander elements 2221 and 2222 is 50 mm.

The length l1 of one side extending in the front-rear direction of each of the meander elements 2221 and 2222 and the length of the connection section 2223 are each an example, and if l1 (the length of one side of the conductor extending in the front-rear direction in the portion that turns in the capacitance loading element 22) is the non-resonant length of the patch antenna 10, the length H1 in the vertical direction, the length L1 in the front-rear direction, and the length of the connection section 2223 are appropriately changeable. For example, the number of times of folding may be changed, as needed, and the length L1 in the front-rear direction may be changed depending on the number of times of folding. Although description has been made assuming that a length on the outer side of the portion that turns is l1 and l1 is the non-resonant length, a length on the inner side of the portion that turns may be more desirably the non-resonant length.

Figure 16:
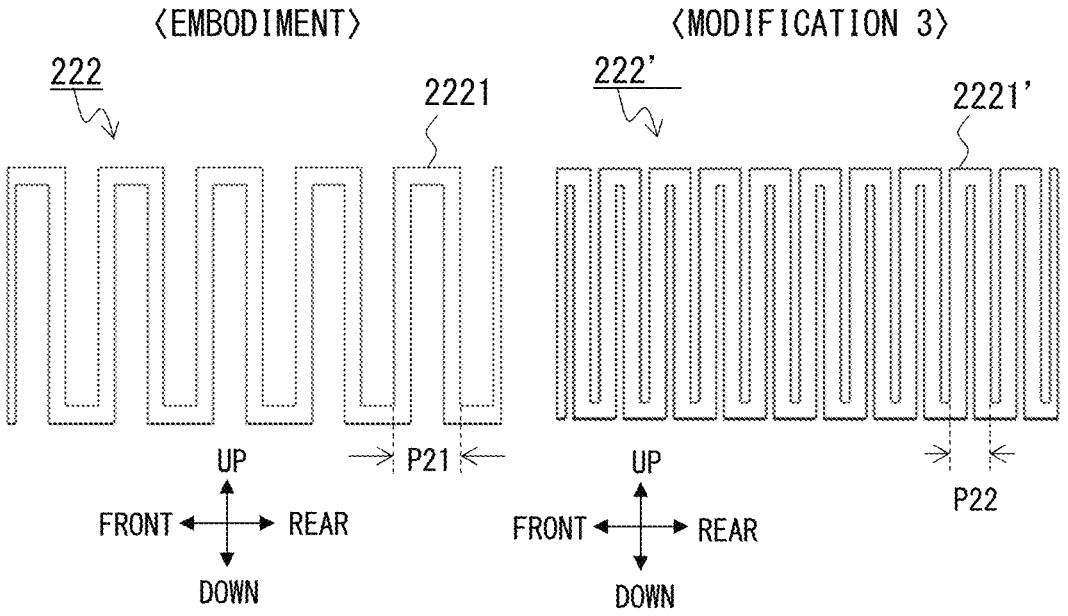
FIG. 16 is a side view of a longitudinal element according to a modification 3 in which a longitudinal element and its pitch have been changed.
Figure 17:
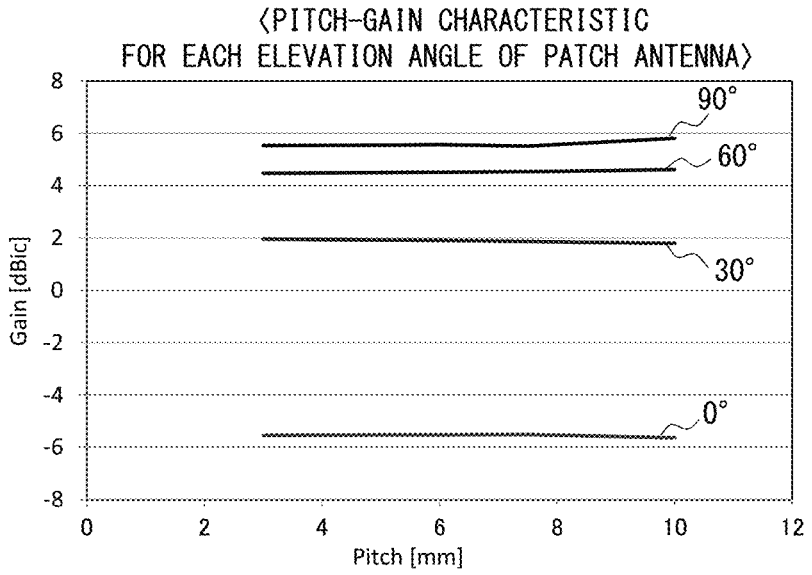
FIG. 17 is a diagram illustrating a pitch-gain characteristic for each elevation angle of a patch antenna using the pitch of the longitudinal element as a parameter.

The longitudinal element 222 can also be formed of various patterns. For example, FIG. 16 is a side view of the longitudinal element 222 and a longitudinal element 222' according to a modification 3 in which a pitch P21 of 6 mm in the longitudinal element 222 has been changed to a pitch P22 of 3 mm. FIG. 17 is a diagram illustrating a gain characteristic for each elevation angle of the patch antenna 10 using the pitch P21 of the longitudinal element 222 as a parameter.

A gain (Gain (an in-horizontal-plane average gain): dBic) in a zenith direction (an elevation angle of 90 degrees) is 5.5 when the pitch P21 of the longitudinal element 222 is 3 mm, is 5.5 when the pitch P21 is 5 mm, is 5.6 when the pitch P21 is 6 mm, is 5.5 when the pitch P21 is 7.5 mm, and is 5.8 when the pitch P21 is 10 mm. A gain (Gain (an in-horizontal-plane average gain): dBic) at an elevation angle of 60 degrees is 4.5 when the pitch P21 is 3 mm, is 4.5 when the pitch P21 is 5 mm, is 4.5 when the pitch P21 is 6 mm, is 4.5 when the pitch P21 is 7.5 mm, and is 4.6 when the pitch P21 is 10 mm. A gain (Gain (an in-horizontal-plane average gain): dBic) at an elevation angle of 30 degrees is 2.0 when the pitch P21 is 3 mm, is 1.9 when the pitch P21 is 5 mm, is 1.9 when the pitch P21 is 6 mm, is 1.9 when the pitch P21 is 7.5 mm, and is 1.8 when the pitch P21 is 10 mm. A gain (Gain (an in-horizontal-plane average gain): dBic) at an elevation angle of 0 degrees is −5.5 when the pitch P21 is 3 mm, is −5.5 when the pitch P21 is 5 mm, is −5.5 when the pitch P21 is 6 mm, is −5.5 when the pitch P21 is 7.5 mm, and is −5.6 when the pitch P21 is 10 mm.

In other words, in the longitudinal element 222, an influence of the pitch P21 on the gain is also small in an SDARS band, and thus, the pitch P21 may be satisfactory when it optimizes respective gains in an AM wave band and an FM wave band.

<Comparison with Element in Comparative Example>

Figure 18:
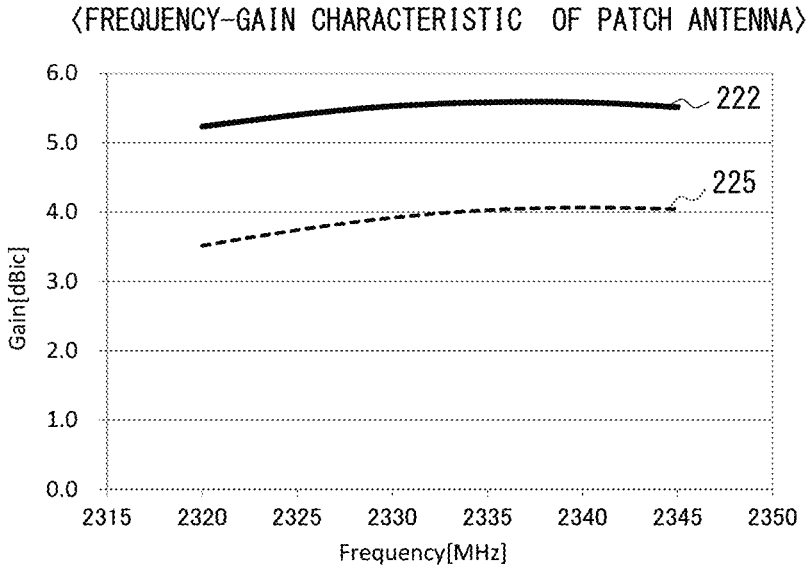
FIG. 18 is a comparison diagram of respective frequency-gain characteristics of the patch antenna in a case where the longitudinal element exists and a case where the element in the comparative example exists.

An antenna characteristic of the longitudinal element 222 is compared with that of the above-described element in the comparative example (the umbrella-type element 225 illustrated in FIG. 12). A comparison diagram of respective frequency-gain characteristics of the patch antenna 10 in a case where the longitudinal element 222 exists and in a case where the umbrella-type element 225 exists is illustrated in FIG. 18. In FIG. 18, a horizontal axis represents a frequency (2320 MHz to 2345 MHz) in the SDARS band, and a vertical axis represents an in-horizontal-plane average gain (dBic) at an elevation angle of 90 degrees. A solid line represents a characteristic in the case where the longitudinal element 222 exists, and a broken line represents a characteristic in the case where the umbrella-type element 225 exists.

If the umbrella-type element 225 exists, the gain (dBic) of the patch antenna 10 is 3.51 in a low frequency band of 2320 MHz, is 3.98 at a use frequency of 2332.5 MHz, and is 4.04 in a high frequency band of 2345 MHz, as described in the first example.

On the other hand, the gain (dBic) of the patch antenna 10 in the case where the longitudinal element 222 exists is 5.23 in a low frequency band of 2320 MHz, is 5.56 at a use frequency of 2332.5 MHz, and is 5.51 in a high frequency band of 2345 MHz. Thus, it is found that a gain at an elevation angle of 90 degrees increases over an entire frequency band in the longitudinal element 222.

Figure 19A:
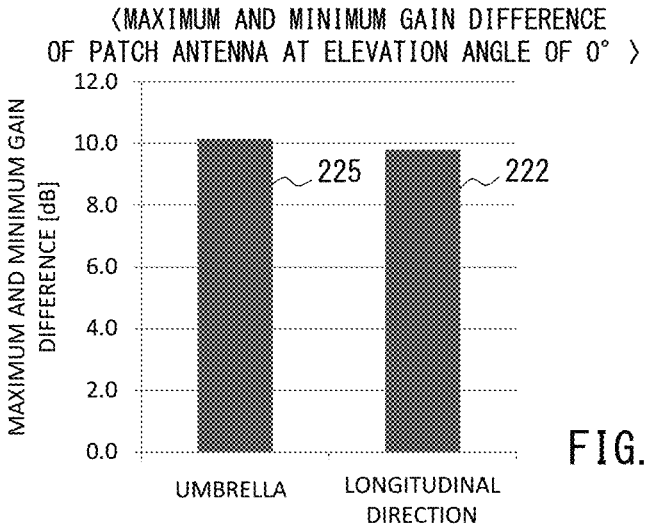
FIG. 19A is a diagram illustrating a comparative example of respective maximum and minimum gain differences of the patch antenna in a case where the longitudinal element exists and a case where the element in the comparative example exists.
Figure 19B:
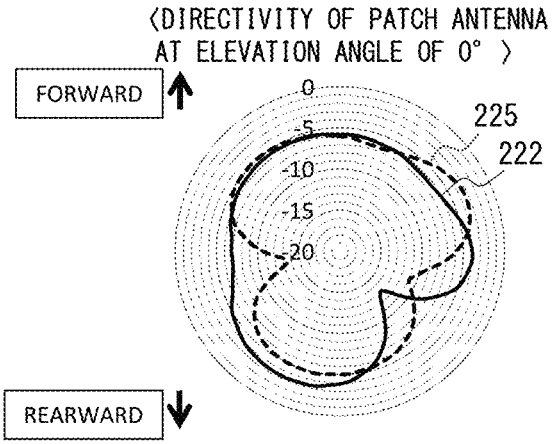
FIG. 19B is a diagram illustrating a comparative example of respective directivities of the patch antenna in a case where the longitudinal element exists and a case where the element in the comparative example exists.

FIG. 19A is a diagram illustrating a comparative example of a maximum and minimum gain difference (dB) of the patch antenna 10 in a use frequency (2332.5 MHz) in the SDARS band at an elevation angle of 0 degrees, and FIG. 19B is a diagram illustrating a comparative example of directivity of the patch antenna 10 at an elevation angle of 0 degrees. A scale (0 to =20) of the directivity is a circularly polarized wave gain (dBic), where an upper part in the drawing is a forward direction and a lower part of the drawing is a rearward direction. The maximum and minimum gain difference (dB) of the patch antenna 10 is 10.1 in the umbrella-type element 225, and is 9.8 in the longitudinal element 222, which are substantially the same.

If the length l1 of one side of the conductor extending in the front-rear direction in the capacitance loading element 22 is the resonant length in the SDARS band, a current in the front-rear direction is generated in the capacitance loading element 22. At this time, the directivity reaches its maximum in the vertical direction of the capacitance loading element 22. As a result, the generated current interferes with directivity in the perpendicular direction of the patch antenna 10.

In the second example, the conductor extending in the front-rear direction is folded to have a meander structure such that the length l1 of the side of the conductor is not a resonant length in the SDARS band. The above-described length l1 in this case is approximately 8 mm. In other words, linear conductors in the capacitance loading element 22 respectively repeatedly turn in the vertical direction of the antenna base section, and a length in the front-rear direction of a portion that turns in each of the linear conductors is a non-resonant length of the patch antenna 10. Thus, as the length l1 is the non-resonant length in the SDARS band, the current in the front-rear direction is not generated, and does not affect the directivity in the perpendicular direction of the patch antenna 10.

[On Characteristics in FM Wave Band and AM Wave Band]

It is found that substantially the same gains are respectively obtained in an FM wave band and an AM wave band in an antenna section (the former) including the lateral element 221 in the first example and an antenna section (the latter) including the longitudinal element 222 in the second example. In other words, a gain (Gain (average gain): dB) in the FM wave band is −0.35 in the former and −0.44 in the latter. A gain (Gain (average gain): dB) in the AM wave band of 500 kHz is −0.95 in the former and −0.81 in the latter.

[Effects of Embodiment]

As described above, in the present embodiment, the meander element (the lateral element 221 or the longitudinal element 222) is used as the capacitance loading element 22, and thus, a degree of connection to the patch antenna 10 also decreases so that interference is further suppressed.

Effects of reducing a maximum and minimum gain difference at an elevation angle of 0 degrees, i.e., in a ground wave is significant in the lateral element 221, and effects of improving a gain in a zenith direction become significant in the longitudinal element 222. Accordingly, the lateral element 221 and the longitudinal element 222 can be separately used depending on their respective applications.

In the lateral element 221, if h1 (the length of one side of the conductor extending in the vertical direction in the portion that turns in the capacitance loading element 22) is the non-resonant length of the patch antenna 10, the length H1 in the vertical direction, the length L1 in the front-rear direction, and the length of the connection section 2213 may each be the resonant length of the patch antenna 10. In a case where h1 of the lateral element 221 is the non-resonant length of the patch antenna 10, the length H1 in the vertical direction and the length of the connection section 2213 may each be the resonant length of the patch antenna 10. However, when the length L1 in the front-rear direction is also the non-resonant length of the patch antenna 10, the directivity in the perpendicular direction of the patch antenna 10 can be improved.

In the longitudinal element 222, if l1 (the length of one side of the conductor extending in the front-rear direction in the portion that turns in the capacitance loading element 22) is the non-resonant length of the patch antenna 10, the length H1 in the vertical direction, the length L1 in the front-rear direction, and the length of the connection section 2213 may each be the resonant length. In a case where l1 of the longitudinal element 222 is the non-resonant length of the patch antenna 10, the length L1 in the front-rear direction and the length of the connection section 2223 may each be the resonant length. However, when the length H1 in the vertical direction is also the non-resonant length of the patch antenna 10, the ground wave directivity of the patch antenna 10 can be improved.

If h1 of the lateral element 221 is the non-resonant length of the patch antenna 10, the length H1 in the vertical direction, the length L1 in the front-rear direction, and the length of the connection section 2213 may each be the non-resonant length. In a case where l1 of the longitudinal element 222 is the non-resonant length of the patch antenna 10, the length H1 in the vertical direction, the length L1 in the front-rear direction, and the length of the connection section 2213 may each be the non-resonant length.

In other words, in the capacitance loading element 22, at least one of the lengths of each of the pair of upper end portions or the pair of lower end portions and each of the respective lengths between the upper end portions and the lower end portions may be the non-resonant length of the patch antenna 10. Thus, the capacitance loading element 22 forms the three-dimensional shape including the pair of upper end portions and the pair of lower end portions respectively opposing each other via a gap interposed therebetween, and at least one of the lengths of each of the pair of upper end portions or the pair of lower end portions and each of the respective lengths between the upper end portions and the lower end portions is the non-resonant length. Thus, even if the capacitance loading element 22 exists near the patch antenna 10, interference therebetween is suppressed.

[Other Modifications]

In the above-described embodiment, although description has been made assuming that the capacitance loading element 22 (the meander elements 2211 and 2212 and the connection section 2213 or the meander elements 2221 and 2222 and the connection section 2223) and the helical element 21 are the same in cross-sectional shape and outer shape, the embodiment is not limited to this. For example, the capacitance loading element 22 and the helical element 21 may differ in at least one of the cross-sectional shape and the outer shape.

Figure 20:
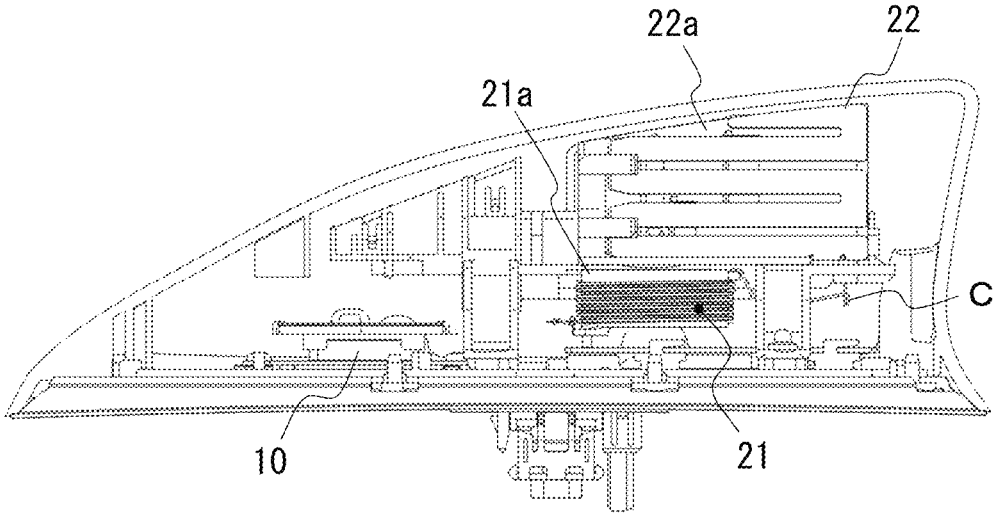
FIG. 20 is a side perspective view illustrating a modification to the first example.

FIG. 20 is a side perspective view illustrating a modification to the first example. FIG. 20 illustrates an example of a lateral element 221. In the lateral element 221, meander elements 2211 and 2212 and a connection section 2213 are linear conductors configured by processing metal components made of the same material, and are fixed to a resin holder 22*a*. A helical element 21 is configured by winding one conductor line around a resin holder 21*a*.

The meander elements 2211 and 2212 and the connection section 2213 have different cross-sectional shapes and outer shapes from those of the helical element 21. The connection section 2213 is provided with a structure to which one end of the helical element can be fastened. In a site C illustrated in FIG. 20, for example, the capacitance loading element 22 and the helical element 21 are electrically connected to each other by soldering or the like. Even in the modification, a length of each of a pair of upper end portions or pair of lower end portions of the lateral element 221 is a non-resonant length of the patch antenna 10. A length in a vertical direction of a portion that turns in the lateral element 221 is a non-resonant length of the patch antenna 10.

A longitudinal element 222 also has a similar structure. In the longitudinal element 222, meander elements 2221 and 2222 and a connection section 2223 are linear conductors configured by processing metal components made of the same material, and are fixed to a resin holder 21*a*.

A helical element 21 is configured by winding one conductor line around a resin holder 21*a*. The meander elements 2221 and 2222 and the connection section 2223 have different cross-sectional shapes and outer shapes from those of the helical element 21. A length of each of the pair of upper end portions or pair of lower end portions of the longitudinal element 222 is a non-resonant length of the patch antenna 10. A length in a front-rear direction of a portion that turns in the longitudinal element 222 is a non-resonant length of the patch antenna 10.

Although a case where the respective lengths of the upper end portions and the lower end portions of the capacitance loading element 22 are each set to three-fourths or less of the wavelength λ of the use frequency of the patch antenna 10 has been described in the present embodiment, the length can be set to less than one-fourth of the wavelength λ of the use frequency when the longitudinal element 222 is used as the capacitance loading element 22.

Although a case where the meander element is used as the capacitance loading element 22 has been described in the present embodiment, a shape may be a planar shape, a mesh shape, a fractal shape, or a zigzag shape if it is a three-dimensional shape having a pair of upper end portions and a pair of lower end portions respectively opposing each other with a gap interposed therebetween, i.e., a shape that is open in the upper end portions and lower end portions of a three-dimensionally shaped element. In such a case, at least one of a length in the front-rear direction of the upper end portions, a length in the front-rear direction of the lower end portions, and a length between the upper end portion and the lower end portion in the capacitance loading element 22 is a non-resonant length of a first antenna.

The meander element may be formed into a surface portion of a holder made of resin. Accordingly, the length in the horizontal direction and the length in the vertical direction can be shortened in an amount corresponding to a dielectric constant. In a case where the holder made of resin is used, the capacitance loading element 22 can also be configured by using a conductive paint to form a pattern of a lateral element, a longitudinal element, a mesh-shaped element, a fractal element, a zigzag element, or the like on a surface of the holder. A shape of the holder may be a rectangular parallelepiped, a cube, or another shape.

Although an example of the patch antenna 10 that receives the SDARS band has been described as an example of the first antenna in the present embodiment, an antenna having another form that receives a signal in a frequency band other than an AM wave band and an FM wave band, e.g., a GNSS (global navigation satellite system) band may be used as the first antenna.

Although a case where the lateral element or the longitudinal element is used as the capacitance loading element 22 using the meander element has been described in the present embodiment, the present embodiment is not limited to this. For example, the linear conductor in the capacitance loading element 22 may include a region that repeatedly turns in the front-rear direction and a region that repeatedly turns in the vertical direction.

Although the capacitance loading element 22 has been described as having a shape that is open in the upper end portions and the lower end portions of the three-dimensional element, the capacitance loading element 22 is also applicable to an element having a shape that is not open in an upper end portion of a three-dimensionally shaped element. In other words, the capacitance loading element 22 may be an umbrella-type element having a top portion. In such a case, at least one of a length in the front-rear direction of upper edge portions, a length in the front-rear direction of lower edge portions, a length between the upper edge portion and the lower edge portion in the umbrella-type capacitance loading element 22 is a non-resonant length of a first antenna.

The invention claimed is:

1. An antenna device for a vehicle, comprising:

an antenna base section which is attachable to a vehicle; and a first element and a second element which are installed away from each other on the antenna base section, wherein:

the first element is a first antenna for a first frequency band;

the second element is a part of a second antenna for a second frequency band different from the first frequency band, and is configured to have a three-dimensional shape in which a pair of linear conductors which respectively repeatedly turn in a predetermined direction are connected to each other via a linear connection conductor extending in a width direction of the antenna base section; and each length of a plurality of folded portions resulting from repeated turns in the predetermined direction, of each of the linear conductors, in the second element, is a non-resonant length of the first antenna.

2. The antenna device for the vehicle according to claim 1, wherein:

the second element repeatedly turns in a front-rear direction of the antenna base section; and a length in a vertical direction of the folded portion of each of the linear conductors is a non-resonant length of the first antenna in the second element.

3. The antenna device for the vehicle according to claim 1, wherein:

the second element repeatedly turns in a vertical direction of the antenna base section; and a length in a front-rear direction of the folded portion of each of the linear conductors, in the second element, is a non-resonant length of the first antenna.

4. An antenna device for a vehicle, comprising:

an antenna base section which is attachable to a vehicle; and a first element and a second element which are installed away from each other on the antenna base section, wherein:

the first element is a first antenna for a first frequency band;

the second element is a part of a second antenna for a second frequency band different from the first frequency band, and is configured to have a three-dimensional shape in which a pair of linear conductors which respectively repeatedly turn in a predetermined direction are connected to each other via a linear connection conductor extending in a width direction of the antenna base section, and at least one of a length in a front-rear direction of an upper edge portion, a length in the front-rear direction of a lower edge portion, and a length in a vertical direction between the upper edge portion and the lower edge portion of each of the pair of linear conductors which respectively repeatedly turn in a predetermined direction is a non-resonant length of the first antenna.

5. The antenna device for the vehicle according to claim 4, wherein the second element includes a pair of the upper edge portions and a pair of the lower edge portions respectively opposing each other with a gap interposed therebetween, and a pair of linear conductors which respectively repeatedly turn in a front-rear direction of the antenna base section are connected to each other via a linear connection conductor extending in a width direction of the antenna base section.

6. The antenna device for the vehicle according to claim 5, wherein a length in the vertical direction of a folded portion of each of the linear conductors is a non-resonant length of the first antenna in the second element.

7. The antenna device for the vehicle according to claim 4, wherein the second element includes a pair of upper edge portions and a pair of lower edge portions respectively opposing each other with a gap interposed therebetween, and a pair of linear conductors which respectively repeatedly turn in the vertical direction of the antenna base section are connected to each other via a linear connection conductor extending in a width direction of the antenna base section.

8. The antenna device for the vehicle according to claim 7, wherein a length in a front-rear direction of a folded portion of each of the linear conductors is a non-resonant length of the first antenna in the second element.

9. The antenna device for the vehicle according to claim 1, wherein a pair of the linear conductor and the connection conductor are configured to be integrally formed.

10. The antenna device for the vehicle according to claim 1, wherein the pair of linear conductors which respectively repeatedly turn form a symmetrical shape with a surface perpendicular to the antenna base section as its center.

11. The antenna device for the vehicle according to claim 4, wherein a length of each of the upper edge portions and the lower edge portions is a non-resonant length of the first antenna, and is three-fourths or less of a wavelength of a frequency used in the first antenna.

12. The antenna device for the vehicle according to claim 1, wherein the second element is formed on a surface portion of a holder made of resin.

13. The antenna device for the vehicle according to claim 1, wherein the second antenna resonates, by connecting the second element to an inductor, in an FM wave band, and the second antenna can receive an AM wave band.

14. The antenna device for the vehicle according to claim 13, wherein the inductor is formed of a linear conductor made of the same member or having the same cross-sectional shape as which of the second element.

15. The antenna device for the vehicle according to claim 1, wherein the first antenna is a patch antenna.

16. The antenna device for the vehicle according to claim 4, wherein a pair of the linear conductor and the connection conductor are configured to be integrally formed.

17. The antenna device for the vehicle according to claim 4, wherein the pair of linear conductors which respectively repeatedly turn form a symmetrical shape with a surface perpendicular to the antenna base section as its center.

18. The antenna device for the vehicle according to claim 4, wherein the second element is formed on a surface portion of a holder made of resin.

19. The antenna device for the vehicle according to claim 4, wherein the second antenna resonates, by connecting the second element to an inductor, in an FM wave band, and the second antenna can receive an AM wave band.

20. The antenna device for the vehicle according to claim 4, wherein the first antenna is a patch antenna.

21. An antenna device for a vehicle, comprising:

an antenna base section which is attachable to a vehicle; and a first element and a second element which are installed away from each other on the antenna base section, wherein:

the first element is a first antenna for a first frequency band;

the second element is a part of a second antenna for a second frequency band different from the first frequency band, and is configured to have a three-dimensional shape in which a pair of linear conductors which respectively repeatedly turn in a front-rear direction of the antenna base section are connected to each other via a linear connection conductor extending in a width direction of the antenna base section; and a length of a folded portion of each of the linear conductors, in the second element, is a non-resonant length of the first antenna.

22. An antenna device for a vehicle, comprising:

an antenna base section which is attachable to a vehicle; and a first element and a second element which are installed away from each other on the antenna base section, wherein:

the first element is a first antenna for a first frequency band;

the second element is a part of a second antenna for a second frequency band different from the first frequency band, and is configured to include a pair of the upper edge portions and a pair of the lower edge portions respectively opposing each other with a gap interposed therebetween, and a pair of linear conductors which respectively repeatedly turn in a front-rear direction of the antenna base section are connected to each other via a linear connection conductor extending in a width direction of the antenna base section, and a length in a front-rear direction of an upper edge portion, a length in the front-rear direction of a lower edge portion, and a length in a vertical direction between the upper edge portion and the lower edge portion is a non-resonant length of the first antenna.

23. An antenna device for a vehicle, comprising:

an antenna base section which is attachable to a vehicle; and a first element and a second element which are installed away from each other on the antenna base section, wherein:

the first element is a first antenna for a first frequency band;

the second element is a part of a second antenna for a second frequency band different from the first frequency band, and is configured to have a three-dimensional shape in which a pair of linear conductors which respectively repeatedly turn in a predetermined direction are connected to each other via a linear connection conductor extending in a width direction of the antenna base section; and each length of a plurality of folded portions, resulting from repeated turns in the predetermined direction, of each of the linear conductors, in the second element, is a non-resonant length of the first antenna, and at least one of a length in a front-rear an upper edge portion, a length in the front-rear direction of a lower edge portion, and a length in a vertical direction between the upper edge portion and the lower edge portion of each of the pair of linear conductors which respectively repeatedly turn in a predetermined direction is a resonant length of the first antenna.

* * * * *